US010408204B2

(12) United States Patent
Suzuki

(10) Patent No.: US 10,408,204 B2
(45) Date of Patent: Sep. 10, 2019

(54) PUMP SYSTEM AND PUMP ABNORMALITY DETECTION METHOD

(71) Applicant: SMC CORPORATION, Chiyoda-ku (JP)

(72) Inventor: Takamitsu Suzuki, Joso (JP)

(73) Assignee: SMC CORPORATION, Chiyoda-ku (JP)

( * ) Notice: Subject to any disclaimer, the term of this patent is extended or adjusted under 35 U.S.C. 154(b) by 536 days.

(21) Appl. No.: 15/014,383

(22) Filed: Feb. 3, 2016

(65) Prior Publication Data

US 2016/0230752 A1 Aug. 11, 2016

(30) Foreign Application Priority Data

Feb. 9, 2015 (JP) ..... 2015-023214

(51) Int. Cl.

| | |
|---|---|
| ***F04B 43/00*** | (2006.01) |
| ***F04B 43/02*** | (2006.01) |
| ***F04B 45/04*** | (2006.01) |
| ***F04B 49/22*** | (2006.01) |
| ***F04B 49/20*** | (2006.01) |
| ***F04B 51/00*** | (2006.01) |

(Continued)

(52) U.S. Cl.

CPC ..... *F04B 43/0081* (2013.01); *F04B 43/009* (2013.01); *F04B 43/0054* (2013.01); *F04B 43/02* (2013.01); *F04B 43/06* (2013.01); *F04B 45/04* (2013.01); *F04B 49/20* (2013.01); *F04B 49/22* (2013.01); *F04B 51/00* (2013.01); *F04B 53/10* (2013.01); *F04B 53/16* (2013.01)

(58) Field of Classification Search

CPC ..... F04B 43/0054; F04B 43/0081; F04B 43/009; F04B 43/02; F04B 43/06; F04B 43/04; F04B 49/20; F04B 49/22; F04B 53/10; F04B 53/16

See application file for complete search history.

(56) References Cited

U.S. PATENT DOCUMENTS

| | | | | |
|---|---|---|---|---|
| 6,554,578 | B1 | 4/2003 | Siegel | |
| 2010/0272589 | A1 | 10/2010 | Fukano et al. | |
| 2012/0011998 | A1* | 1/2012 | Johansson | F04B 43/067 92/47 |

FOREIGN PATENT DOCUMENTS

| | | | |
|---|---|---|---|
| DE | 198 26 610 | A1 | 12/1999 |
| DE | 10 2009 048 721 | A1 | 11/2010 |

(Continued)

OTHER PUBLICATIONS

Office Action dated Dec. 19, 2017 in Japanese Patent Application No. 2015-023214 (with English language translation of pertinent portion), 7pages.

(Continued)

*Primary Examiner* — Philip E Stimpert

(74) *Attorney, Agent, or Firm* — Oblon, McClelland, Maier & Neustadt, L.L.P.

(57) ABSTRACT

A pump system is equipped with a body, a displacement body, a bellows member, an indirect medium, and a diaphragm. The pump system is further equipped with a pressure sensor configured to detect a pressure of the indirect medium in a charge chamber, the charge chamber being formed to include an interior space of the bellows member in the interior of the body. A controller of the pump system determines an abnormality of the diaphragm based on detection values detected by the pressure sensor.

17 Claims, 8 Drawing Sheets

(51) Int. Cl.

| | |
|---|---|
| ***F04B 53/10*** | (2006.01) |
| ***F04B 53/16*** | (2006.01) |
| ***F04B 43/06*** | (2006.01) |

(56) References Cited

FOREIGN PATENT DOCUMENTS

| | | | |
|---|---|---|---|
| DE | 10 2010 060 532 | A1 | 5/2012 |
| JP | 4-171122 | A | 6/1992 |
| JP | 11-173271 | A | 6/1999 |
| JP | 2002-518635 | A | 6/2002 |
| JP | 2009-97415 | A | 5/2009 |
| JP | 2010-255578 | | 11/2010 |

OTHER PUBLICATIONS

Office Action dated Apr. 5, 2016 in Japanese Patent Application No. 2015-023214 (with partial English translation).
German Office Action dated Dec. 13, 2018 in Patent Application No. 10 2016 101 080.4 (with reporting letter), 7 pages.

* cited by examiner

10

10

16
THREE-WAY VALVE
FLUID
20
NOTIFICATION UNIT
28
PUMP HEAD
40
DIAPHRAGM
14
M
INDIRECT MEDIUM
32
74
DISPLACEMENT BODY
30
ROTARY DRIVE SOURCE
CONTROL SIGNAL S
DETECTION SIGNAL P
18
CONTROLLER
90
CONTROL UNIT
12
APPLIED APPARATUS

10

PUMP SYSTEM AND PUMP ABNORMALITY DETECTION METHOD

CROSS-REFERENCE TO RELATED APPLICATION

This application is based upon and claims the benefit of priority from Japanese Patent Application No. 2015-023214 filed on Feb. 9, 2015, the contents of which are incorporated herein by reference.

BACKGROUND OF THE INVENTION

Field of the Invention

The present invention relates to a pump abnormality detection method and to a pump system for detecting an abnormality, in a pump for quantitatively discharging a fluid.

Description of the Related Art

In various types of devices, for example, apparatus for manufacturing semiconductors, coating apparatus, medical equipment, or the like, cases exist in which a function is sought for supplying fluids (e.g., process gases, cleaning solutions, paints, chemical liquids, etc.) with high accuracy at a constant rate to a discharge target. In this case, a constant delivery type of pump (a so-called dispensing pump) is attached to such devices.

As one such pump of this type, the technology disclosed in Japanese Laid-Open Patent Publication No. 2010-255578 has previously been proposed by the present applicant. The pump disclosed in Japanese Laid-Open Patent Publication No. 2010-255578 includes a body, a pump chamber provided in the interior of the body and in which fluid is capable of flowing, and a charge chamber which is charged with an indirect medium, and which is disposed on an opposite side from the pump chamber with a diaphragm being interposed between the charge chamber and the pump chamber in the interior of the body. The charge chamber of the pump is closed by a displacement mechanism and a bellows, etc., and is constituted such that the charge chamber is capable of expanding and contracting. More specifically, by expansion and contraction of the charge chamber, the pump causes the indirect medium to flow and deform the diaphragm, thereby causing the fluid in the interior of the pump chamber to flow in and flow out in a quantitative way.

SUMMARY OF THE INVENTION

Incidentally, in this type of pump, abnormalities tend to occur due to accumulation of loads or the like with use over time or as a result of aging. For example, since the diaphragm is constituted from a material (an elastic material or the like) whose strength is comparatively weak, abnormalities are likely to appear, leading to a decrease in the constant delivering function. Therefore, it is desirable to detect such abnormalities of the diaphragm at an early stage.

The present invention has been devised in relation to the proposed technology discussed above, and has the object of providing a pump system and a pump abnormality detection method which, by detecting abnormalities of the diaphragm at an early stage, can suppress an influence due to malfunctions of the pump, and is capable of enhancing usability.

For achieving the aforementioned object, the present invention is characterized by a pump system including a body having a pump chamber into and from which a fluid is capable of flowing in and flowing out, a displacement body configured to be displaceable along an axial direction of the body in the interior of the body, a connecting member interposed between the displacement body and the body, an indirect medium formed from a non-compressible fluid, and with which a charge chamber including an interior space is charged, the connecting member liquid-sealing the indirect medium in the interior space at the interior of the body, and a diaphragm disposed between the charge chamber and the pump chamber in the interior of the body, and configured to, under a flowing action of the indirect medium, cause the fluid to flow into and flow out of the pump chamber, the pump system further including a pressure detector configured to detect a pressure of the indirect medium in the charge chamber, and a judgment processor configured to determine an abnormality of the diaphragm based on detection values detected by the pressure detector.

According to the above, by providing the pump system with the pressure detector that detects a pressure of the indirect medium, and the judgment processor that determines an abnormality of the diaphragm based on detection values, the user is capable of easily and quickly confirming an abnormality of the diaphragm. More specifically, since the pressure of the indirect medium that is liquid-sealed in the charge chamber directly influences deformation of the diaphragm, by the judgment processor monitoring such a pressure, an abnormality of the diaphragm can rapidly be discovered. Consequently, for example, it is possible to carry out maintenance or replacement (exchange) of the pump at an early stage, and an abnormality of the pump (a change in the discharge rate of the fluid, leakage of the indirect medium, etc.) due to accumulation of loads or deterioration over time that may occur in the apparatus can suitably be suppressed.

In this case, the body may include a charging port that communicates with the charge chamber, the charge chamber being charged with the indirect medium through the charging port, and the pressure detector may include a detector, the detector being inserted and fixed in the charging port and closing the charging port.

In this manner, by insertion and fixing of the detector of the pressure detector in the charging port, the charge chamber which is charged with the indirect medium can easily be closed and sealed, and the pressure of the charge chamber can reliably be detected. Furthermore, because a configuration for disposing the pressure detector separately on the body or the like is unneeded, the structure of the pump system can be simplified.

Further, the pressure detector may be disposed at a position near the diaphragm.

In this manner, by disposing the pressure detector at a position in the vicinity of the diaphragm, the pressure that the indirect medium imposes on the diaphragm can be detected with high accuracy.

The pump system preferably further includes a notification unit configured to notify the presence of an abnormality, in the case that the judgment processor determines that an abnormality of the diaphragm exists.

In this manner, in the case that the judgment processor determines an abnormality to exist in the diaphragm, by the presence of the abnormality being notified by the notification unit, the abnormality of the pump can easily be confirmed by the operator.

The pump system may further include a solenoid valve configured to supply the fluid to the pump chamber or discharges the fluid from the pump chamber, and the judgment processor may halt operation of the solenoid valve in the case it is determined that an abnormality of the diaphragm exists.

In this manner, in the case that the judgment processor determines an abnormality to exist in the diaphragm, by operation of the solenoid valve being halted, flowing of fluid into the pump chamber is interrupted, and escaping of the indirect medium into the solenoid valve and mixing thereof with the fluid can be prevented.

The pump system may further include a drive unit on an end of the body, the drive unit being configured to displace the displacement body along the axial direction upon energizing of the drive unit, and the judgment processor may halt energizing of the drive unit in the case it is determined that an abnormality of the diaphragm exists.

In this manner, in the case that the judgment processor determines an abnormality to exist in the diaphragm, by halting the energizing of the drive unit, since flowing of the fluid by the pump is stopped, outflow of the indirect medium can effectively be suppressed.

Still further, the pump system may be disposed on an apparatus that receives outflow of the fluid from the pump chamber, and the judgment processor may be connected to a control unit of the apparatus or is installed with respect to the control unit, and halts operation of the apparatus in the case it is determined that an abnormality of the diaphragm exists.

Owing thereto, operation of the apparatus on which the pump system is provided can be halted promptly, and an adverse influence imparted to the discharge target of the apparatus can be suppressed.

In addition, the judgment processor may determine an abnormality of the diaphragm, by comparing, with a threshold value, a maximum pressure in a stable state period within a pressure waveform of the detection values.

Further, the judgment processor may determine an abnormality of the diaphragm, by comparing, with a threshold value, an average pressure in a stable state period within a pressure waveform of the detection values.

The judgment processor may determine an abnormality of the diaphragm, by comparing, with a threshold value, a minimum pressure in a stable state period within a pressure waveform of the detection values.

The judgment processor may determine an abnormality of the diaphragm, by comparing, with a threshold value, a maximum pressure during a rise in pressure within a pressure waveform of the detection values.

The judgment processor may determine an abnormality of the diaphragm, by calculating a sum of the detection values within a predetermined period, and comparing the sum with a sum threshold value.

The judgment processor may determine an abnormality of the diaphragm, by comparing, with an angular threshold value, a gradient of a pressure waveform of the detection values.

The judgment processor may determine an abnormality of the diaphragm, by detecting a time delay of a rise or a fall in pressure from within a pressure waveform of the detection values.

The judgment processor may determine an abnormality of the diaphragm, by detecting a time delay until transitioning to a stable state from within a pressure waveform of the detection values.

In accordance with a judgment method of the judgment processor presented above, the pump system is capable of easily detecting an abnormality in the diaphragm based on a change in the pressure of the indirect medium.

In this case, the judgment processor preferably should determine an abnormality of the diaphragm, by performing a plurality of different types of judgments.

In this manner, by performing the plurality of different types of judgments, since the pump system is capable of determining the state of the diaphragm using different methods, abnormalities of the diaphragm can be determined more reliably.

Furthermore, the judgment processor may determine an abnormality of the diaphragm, using a plurality of pressure waveforms of the detection values.

In this manner, by judging the presence of an abnormality of the diaphragm using a plurality of pressure waveforms of the detection values, the pump system is capable of determining an abnormality of the diaphragm with greater precision.

Further, for resolving the aforementioned problems, the present invention is characterized by a pump abnormality detection method for a pump that includes a body having a pump chamber into and from which a fluid is capable of flowing in and flowing out, a displacement body configured to be displaceable along an axial direction of the body in the interior of the body, a connecting member interposed between the displacement body and the body, an indirect medium formed from a non-compressible fluid, and with which a charge chamber including an interior space is charged, the connecting member liquid-sealing the indirect medium in the interior space at the interior of the body, and a diaphragm disposed between the charge chamber and the pump chamber in the interior of the body, and configured to, under a flowing action of the indirect medium, cause the fluid to flow into and flow out of the pump chamber. The pump abnormality detection method includes the steps of detecting a pressure of the indirect medium in the charge chamber, with a pressure detector, and determining an abnormality of the diaphragm based on detection values detected by the pressure detector, with a judgment processor.

According to the present invention, by detecting abnormalities of the diaphragm at an early stage, it is possible to suppress an influence caused by malfunctions of the pump, and enhance usability.

The above and other objects, features and advantages of the present invention will become more apparent from the following description when taken in conjunction with the accompanying drawings, in which a preferred embodiment of the present invention is shown by way of illustrative example.

DESCRIPTION OF THE PREFERRED EMBODIMENTS

Below, concerning a pump system according to the present invention, a preferred embodiment in relation to an abnormality detection method for a pump will be described in detail with reference to the accompanying drawings.

The pump system 10 according to the embodiment is installed in an apparatus for manufacturing a semiconductor or the like, a coating apparatus or medical equipment or the like (referred to as "applied apparatus 12" below; see FIG. 2), and includes a function to discharge a fluid L at a constant rate onto a discharge target of the applied apparatus 12. Note that the pump system 10 is not limited to any particular application of use, and may be applied to a variety of devices and fluid paths.

Figure 1:
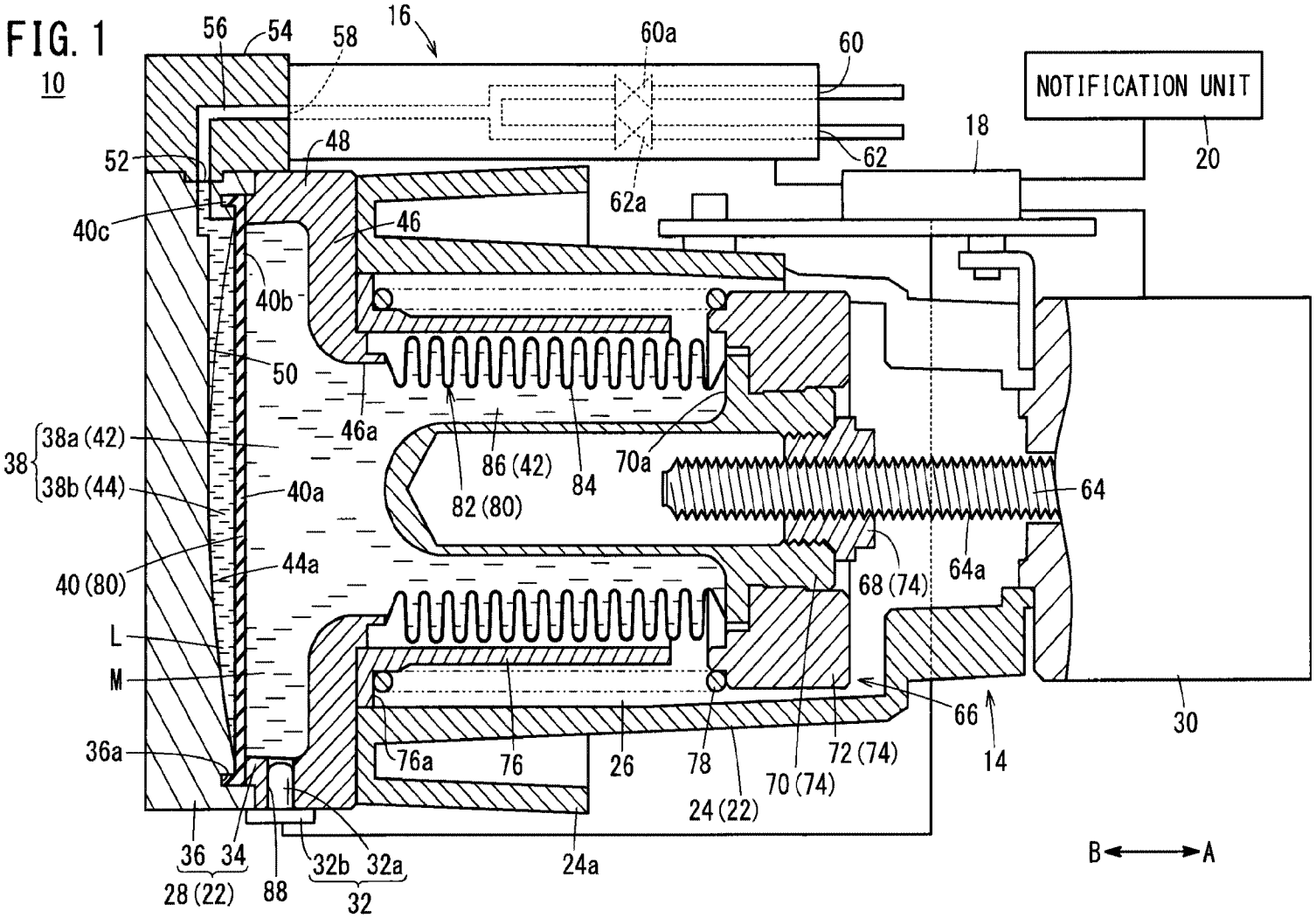
FIG. 1 is a partial side cross-sectional view showing the overall structure of a pump system according to an embodiment of the present invention.

As shown in FIG. 1, the pump system 10 includes a pump main body section 14 (hereinbelow referred to simply as a pump 14), a three-way valve 16 that performs supply and discharge of the fluid L with respect to the pump 14, and a controller 18 that controls operation of the pump 14. Further, a notification unit 20 (notification means) for notifying that an abnormality of the pump 14 exists is connected to the controller 18.

Hereinbelow, aside from describing the positions and directions of the various components of the pump system 10 along the arrow A direction and the arrow B direction in FIG. 1, the arrow A direction also refers to the proximal end direction (proximal end side) of the pump 14, whereas the arrow B direction also refers to the distal end direction (distal end side) of the pump 14.

The pump 14 includes a body 22 having an internal structure made up of various members, to be described later. The body 22 of the pump 14, for example, is constituted from a metal material, and includes a housing 24 having therein a hollow space 26, and a pump head 28 that closes one end of the housing 24 in the arrow B direction. Further, a rotary drive source 30 (drive unit) for operating the pump 14 is installed on another end side (the side in the arrow A direction) of the body 22. Furthermore, the three-way valve 16, a pressure sensor 32 (pressure detector), and the controller 18 are mounted on a side circumferential surface of the body 22.

The housing 24 that constitutes the body 22 is a cylindrical body with a tapered shape the inner and outer diameters of which become larger along the direction of the arrow B. On an end of the housing 24 on the arrow B direction side, a folded back portion 24*a* is formed integrally therewith. The folded back portion 24*a* is bent substantially at a right angle and projects out slightly in the radially outward direction, and is bent further substantially at a right angle and extends a predetermined length along the direction of the arrow A from the projecting end part thereof. The folded back portion 24*a* is separated from the outer circumferential surface of the main body portion of the housing 24, and stably supports the three-way valve 16 in cooperation with the pump head 28.

The pump head 28 is a block body that is disposed on a distal end of the housing 24 and closes an opening of the hollow space 26. The pump head 28 is constructed by arranging one block on another block (first and second blocks 34, 36), which are formed in a divided manner, in the axial direction of the body 22. In the assembled state, in the interior of the pump head 28, a hollow cavity 38 of a predetermined volume is formed. Further, a later-described diaphragm 40 is sandwiched and gripped between the first block 34 and the second block 36.

Consequently, the hollow cavity 38 of the pump head 28 is of a divided structure with the diaphragm 40 sandwiched therein. A hollow cavity 38*a* on the proximal end side with respect to the diaphragm 40 (a space formed by the first block 34) makes up a portion of a charge chamber 42 which is charged with the indirect medium M, which is made up from a non-compressible fluid. On the other hand, a hollow cavity 38*b* on the distal end side with respect to the diaphragm 40 (a space formed by the second block 36) forms a pump chamber 44 into and from which the fluid L flows in and out.

The indirect medium M, with which the charge chamber 42 is charged, is not limited in particular, but preferably is a fluid which is higher in density than the fluid L of the pump chamber 44, for which a working oil such as silicone oil or the like may be given as an example. On the other hand, the fluid L that flows in the pump chamber 44 (the fluid L that is ejected from the pump 14), depending on the use to which the pump system 10 is applied, for example, may be any of various fluids such as a process gas, a cleaning liquid, a coating material (including a coating liquid), and a chemical solution, etc. Below, a representative case will be described in which the pump system 10 is installed on a semiconductor manufacturing apparatus as one type of applied apparatus 12, and a coating liquid is discharged therefrom as the fluid L.

The first block 34 of the pump head 28 includes a proximal end plate member 46 that is affixed to a distal end surface of the housing 24, and a side wall 48 that surrounds the proximal end plate member 46. An opening space 46*a*, which is defined by a radially inward edge of the proximal end plate member 46, is formed with a small inner diameter that matches with that of an interior space 86 of a later described bellows member 82, and communicates with the interior space 86 in a state of being attached to the housing 24. On the other hand, a space that is surrounded by the side wall 48 on the distal end side with respect to the proximal end plate member 46 is formed with a comparatively large inner diameter that matches with the inner diameter of the pump chamber 44.

The outer diameter of the second block 36 of the pump head 28 matches with the outer diameter of the side wall 48 of the first block 34, and is formed in a plate shape having a sufficient thickness. On a proximal end on an outer edge of the second block 36, a recessed engagement portion 36*a* is provided, which is capable of engagement with a protruding portion 40*c* of the diaphragm 40. A distal end on the outer edge of the first block 34 faces the engagement portion 36*a* and sandwiches the diaphragm 40 therebetween.

The pump chamber 44 of the pump 14 is constituted from a hemispherical surface 44*a* that is recessed in a substantially hemispherical shape, in a direction away from the first block 34, on the proximal end surface side of the second block 36. Further, the second block 36 includes a fluid passage 50 that extends radially outward at a predetermined position of the pump chamber 44. The fluid passage 50 communicates with the pump chamber 44 by a predetermined portion of the hemispherical surface 44*a* being cutout in the shape of a groove, extends in a straight line from the pump chamber 44 toward a side circumferential surface of the second block 36, and communicates with a fluid port 52 that opens on the side circumferential surface.

A connecting plug 54 is fixed to the side circumferential surface of the pump head 28 face-to-face with the fluid port 52, and the three-way valve 16 is fixed to a proximal end surface of the connecting plug 54. A connecting passage 56 that communicates with the fluid port 52 is disposed in the interior of the connecting plug 54. The connecting passage 56 passes through the interior of the connecting plug 54 and reaches the proximal end surface, where the connecting passage 56 communicates with a flow passage of the three-way valve 16.

The three-way valve 16, for example, includes a first port 58 that communicates with the connecting passage 56, a second port 60 connected to a non-illustrated semiconductor coating liquid supply source, and a third port 62 connected to a non-illustrated coating liquid dispenser. Additionally, solenoid valves 60*a*, 62*a* are disposed respectively on rear side flow paths of the second port 60 and the third port 62 in the interior of the three-way valve 16, and the solenoid valves are capable of switching the state of communication mutually between the ports.

For example, when the fluid L is supplied to the pump 14, the second port 60 and the first port 58 are placed in communication under a switching action of the solenoid valves 60*a*, 62*a*, and the fluid L is supplied to the pump 14 from the coating liquid supply source through the second port 60, the first port 58, and the connecting passage 56. Conversely, when the fluid L is ejected from the pump 14, the third port 62 and the first port 58 are placed in communication under a switching action of the solenoid valves 60*a*, 62*a*, and the fluid L is discharged to the coating liquid dispenser from the pump 14 through the connecting passage 56, the first port 58, and the third port 62. Moreover, the three-way valve 16 may be equipped not only with the solenoid valves 60*a*, 62*a* in the interior thereof as described above, but check valves (not shown) may also be provided, respectively, in the second port 60 and the third port 62 in mutually opposite directions.

On the other hand, a stepping motor is applied for the rotary drive source 30, which is provided on an end of the body 22 on the side in the arrow A direction, and comprises a drive shaft 64 that is rotated based on a control signal S (energizing action) of the controller 18. The drive shaft 64 is inserted a predetermined length into the hollow space 26 of the housing 24, in a state in which the rotary drive source 30 is connected to the housing 24. Further, a male screw section 64*a* is formed on an outer circumferential surface of the drive shaft 64, and a displacement nut 68 of a displacement mechanism 66, which is constructed in the interior of the body 22, is threaded over the male screw section 64*a*. It should be noted that the structure for driving the displacement mechanism 66 is not limited to the rotary drive source 30, and various types of actuators (pressing devices, etc.) may be applied to such a structure.

The displacement mechanism 66 includes the aforementioned displacement nut 68, a bottomed tubular body 70 fixed to a distal end of the displacement nut 68 and which covers portions of the displacement nut 68 and the drive shaft 64, and a ring-shaped body 72 disposed on the outer circumferential surface of the tubular body 70. Further, under a rotating action of the drive shaft 64 by the rotary drive source 30, the displacement nut 68 is displaced together with the tubular body 70 and the ring-shaped body 72 along the axial direction of the housing 24. Hereinbelow, the displacement nut 68, the tubular body 70, and the ring-shaped body 72 will be referred to collectively as a displacement body 74.

The displacement mechanism 66 is further equipped with a spring guide 76 and a spring 78 in the interior of the housing 24. The spring guide 76 guides the expansion and contraction of the spring 78 and is formed in a tubular shape outwardly covering in a non-contact manner the side circumferential surface of the later-described bellows member 82. Further, an end of the spring guide 76 on a side in the direction of the arrow B projects radially outward and forms a seat for the spring 78, and serves as a fixing member 76*a* that is fixed together with the housing 24 on an end surface of the first block 34.

The spring 78, for example, is constituted from a coil spring, and is disposed so as to surround the outer circumferential side of the spring guide 76. A distal end of the spring 78 is mounted on the fixing member 76*a* of the spring guide 76, whereas the proximal end of the spring 78 is mounted on a seat formed on the distal end of the ring-shaped body 72. The spring 78 urges the displacement body 74 in the direction (proximal end direction) of the arrow A.

When a rotational drive force of the rotary drive source 30 is converted into linear movement of the displacement body 74 along the axial direction, the spring 78 and the spring guide 76 prevent backlash of the drive shaft 64 and the displacement nut 68. Consequently, the displacement body 74 is displaced with high accuracy, and the fluid L is ejected in a stable manner.

In addition, a discharge mechanism 80 that carries out constant delivering of the fluid L is disposed on a distal end side of the displacement body 74 in the interior of the pump 14. The discharge mechanism 80 includes the aforementioned diaphragm 40, and the bellows member 82 (connecting member), which is interposed between the proximal end of the first block 34 and the distal end of the ring-shaped body 72 of the displacement mechanism 66.

The diaphragm 40 is formed and constituted in a disk shape from a resin material (e.g., an elastic material such as rubber containing PTFE or the like). The diaphragm 40 comprises a disk-shaped main membrane 40*a* located in a central vicinity, a peripheral edge membrane 40*b* contiguous with a radially outer side of the main membrane 40*a*, and a protruding portion 40*c*, which is bent toward a distal end side on the outermost edge of the peripheral edge membrane 40*b*. By the protruding portion 40*c* being fixed to the pump head 28, the main membrane 40*a* and the peripheral edge membrane 40*b* are displaceable in a perpendicular direction to the planar direction of the diaphragm 40.

The bellows member 82, for example, is formed in a hollow cylindrical shape from a metal material such as SUS or the like. The side circumferential surface of the bellows member 82 is formed as a bellows section 84 which is repeatedly recessed and projects out radially (in a wavy or corrugated shape) along the axial direction of the drive shaft 64. The distal end of the bellows member 82 is fixed to an end that forms the opening space 46*a* of the first block 34, whereas the proximal end of the bellows member 82 is fixed to a flange 70*a* of the tubular body 70. Fixing of the bellows member 82 to the first block 34 and the tubular body 70 is carried out, for example, by welding or the like.

The interior space 86 on the inside of the bellows member 82 communicates with the hollow cavity 38 of the first block 34, and is filled with the indirect medium M. More specifically, the hollow cavity 38*a* of the first block 34 and the interior space 86 of the bellows member 82 constitute the charge chamber 42 in which the indirect medium M is accommodated, and serve to liquid-seal the indirect medium M therein. Further, the tubular body 70 is arranged in an axial center portion of the interior space 86.

The bellows section 84 of the bellows member 82 is thinly formed such that concave and convex parts thereof can easily approach and separate mutually. Therefore, the bellows member 82 expands and contracts in the axial direction of the drive shaft 64 (i.e., the pump 14) accompanying displacement of the displacement body 74. Accordingly, a pressure is applied to the indirect medium M in the interior space 86, and the indirect medium M flows in an axial direction through the charge chamber 42. It should be noted that the connecting member that constitutes the charge chamber 42 in the pump 14 is not limited to the bellows member 82, and may be constituted in various ways. For example, the connecting member may be formed in a cylindrical shape, and constructed with a piston that is displaced in the interior (the charge chamber 42) thereof.

Further, a charging port 88 for charging the charge chamber 42 with the indirect medium M is disposed in the pump head 28 (first block 34). After the charge chamber 42 has been filled with the indirect medium M, the pressure sensor 32 is inserted and fixed in the charging port 88. More specifically, the charge chamber 42 becomes a closed spaced by engagement and fitting of the pressure sensor 32 in the charging port 88.

The pressure sensor 32 is a pressure detecting device, which detects the pressure of the indirect medium M with which the charge chamber 42 is charged. The pressure sensor 32 includes a detector 32*a* on the side of the surface that faces toward the charge chamber 42 in the interior of the charging port 88, and a transmitter 32*b* that is exposed on the outer circumferential surface of the body 22. The transmitter 32*b* is connected so as to be capable of transmitting signals to the controller 18. Further, responsive to a command from the controller 18 (or at regular intervals), the pressure sensor 32 transmits the detected pressure (detection value) of the indirect medium M as a detection signal P to the controller 18.

The detector 32*a* of the pressure sensor 32 preferably is arranged in a position near to the diaphragm 40. Consequently, the pressure that the fluid L imposes on the diaphragm 40 can be detected with higher accuracy. The pressure sensor 32 need not necessarily be disposed in the charging port 88, and may be disposed at any appropriate position that enables detection of pressure inside the charge chamber 42. Further, the transmitter 32*b* may serve as a packing that reliably closes and seals the charging port 88 on the outer side of the pump head 28.

The controller 18 is mounted at a position distanced from the housing 24, and closer to the proximal end side of the outer circumferential surface of the housing 24, in order to control operation of the pump system 10. As the controller 18, a well-known type of electronic circuit (computer), which includes an input/output unit, a storage unit, and a computation unit, none of which are shown, can be used.

Figure 2:
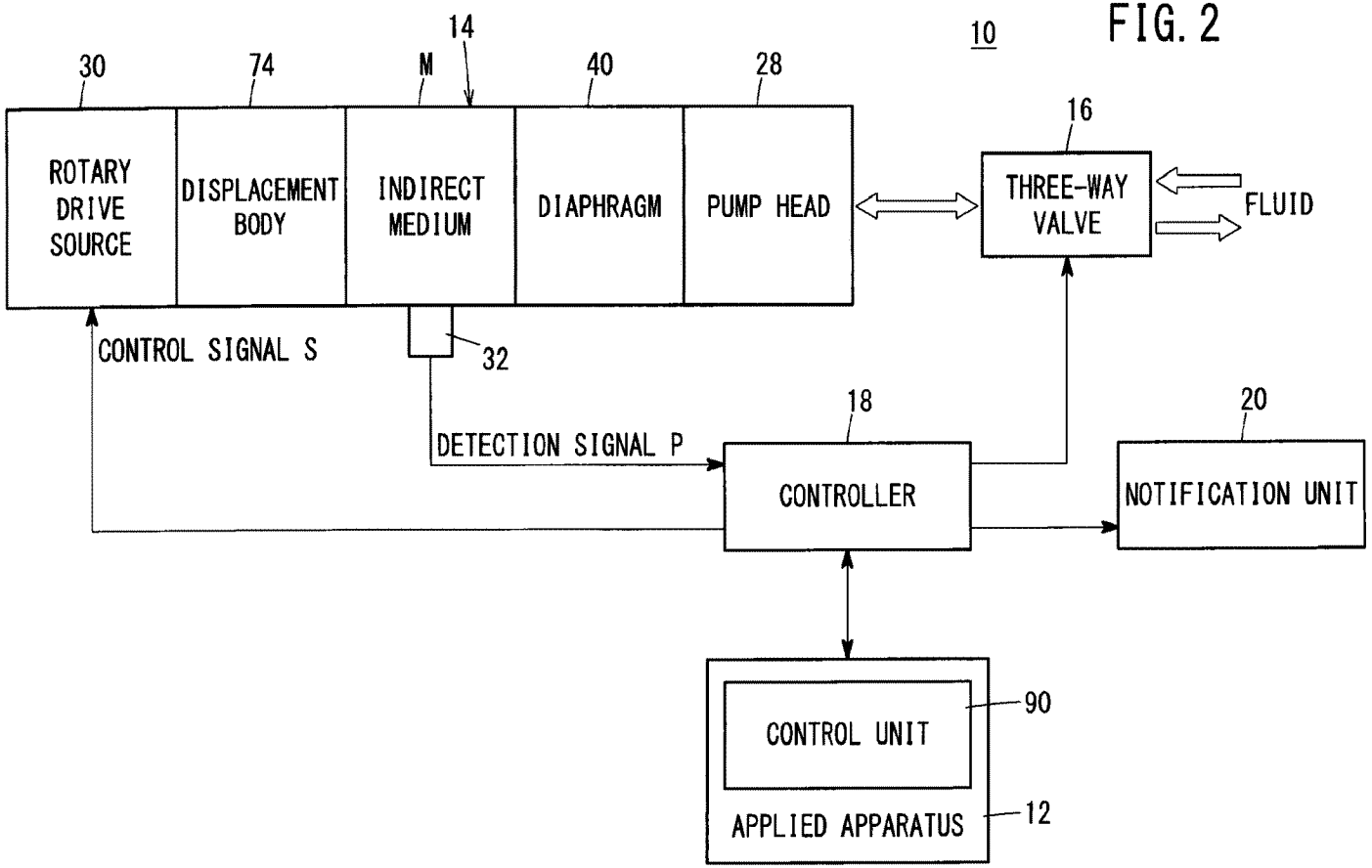
FIG. 2 is a functional block diagram showing schematically a relationship between structural elements of the pump system.

As shown in FIG. 2, the controller 18 receives a control command, for example, from a control unit 90 of the applied apparatus 12, and rotates at a predetermined timing the drive shaft 64 of the rotary drive source 30. As a result, the displacement body 74 is displaced to thereby pressurize the indirect medium M, whereby the diaphragm 40 undergoes deformation through the pressure of the indirect medium M, and the fluid L of the pump head 28 (in the pump chamber 44) is made to flow. Further, the controller 18 also functions as a judgment processor for receiving from the pressure sensor 32 the detection value of the pressure of the indirect medium M and determining an abnormality of the pump 14 based on the detection value. The abnormality detection method performed by the controller 18 for detecting abnormalities of the pump 14 will be described in greater detail later. The judgment processor need not only be provided in the controller 18 for each respective pump 14, but also may be arranged in the control unit 90 that controls the applied apparatus 12 as a whole.

The notification unit 20 is connected to the controller 18. When an abnormality is detected, the controller 18 notifies an operator of the applied apparatus 12 of the presence of the abnormality of the pump 14 through the notification unit 20. As the notification unit 20, for example, there may be used a speaker for outputting a warning sound or voice output, a display for displaying a warning display, or a light emitting device, etc.

Alternatively, in the case that the three-way valve 16 is operated as a solenoid valve, the controller 18 may halt operation of the three-way valve 16. Accordingly, flowing of the fluid L to the pump 14 can be interrupted, together with preventing outflow of the indirect medium M to the three-way valve 16 in the event that damage to the diaphragm 40 has occurred. Furthermore, when an abnormality is detected, the controller 18 may stop the energization to the rotary drive source 30, or in other words, may halt operation of the pump 14. Accordingly, in the event that damage to the diaphragm 40 has occurred, outflow of the indirect medium M can effectively be suppressed. Still further, when an abnormality is detected, the controller 18 may halt operation of the applied apparatus 12. Owing thereto, the applied apparatus 12 can be stopped at an early stage, and an adverse influence imparted to the discharge target of the applied apparatus 12 can be suppressed.

The pump system 10 according to the present embodiment is constructed basically as described above. Next, operations of the pump system 10 will be described with reference to FIGS. 3, 4 and 5. Below, the position shown in FIG. 3, in which the displacement body 74 (displacement nut 68, tubular body 70, ring-shaped body 72) is displaced to the side of the rotary drive source 30, will be described as an initial condition (initial position).

In the initial condition of the pump system 10, based on the rotary drive from the rotary drive source 30, the ring-shaped body 72 of the displacement body 74 is placed at a position near to or in contact with an inner side stepped portion in the interior of the housing 24. At such a position, by expansion of the bellows member 82 in the axial direction, the indirect medium M flows toward the proximal end side, and the main membrane 40*a* of the diaphragm 40 becomes recessed toward the proximal end side more so than the peripheral edge membrane 40*b*. As a result, in the pump chamber 44 in the initial condition, a negative pressure is developed, and a state is brought about such that a predetermined amount of the fluid L flows into the pump chamber 44 from the three-way valve 16 through the first port 58, the connecting passage 56, the fluid port 52, and the fluid passage 50.

In the pump system 10, from the initial condition described above, the controller 18 outputs a control signal S to the rotary drive source 30 at a predetermined timing (time t1 shown in FIG. 5), whereupon the drive shaft 64 of the rotary drive source 30 is rotated. Consequently, the displacement mechanism 66 converts the rotation of the drive shaft 64 into linear motion, and the displacement body 74 is displaced in the direction of the distal end. Accompanying displacement of the displacement body 74, the proximal end of the bellows member 82 is moved in the direction of the distal end, and the bellows member 82 as a whole is compressed axially. Accordingly, a pressing force is applied to the indirect medium M in the interior of the bellows member 82.

Figure 5:
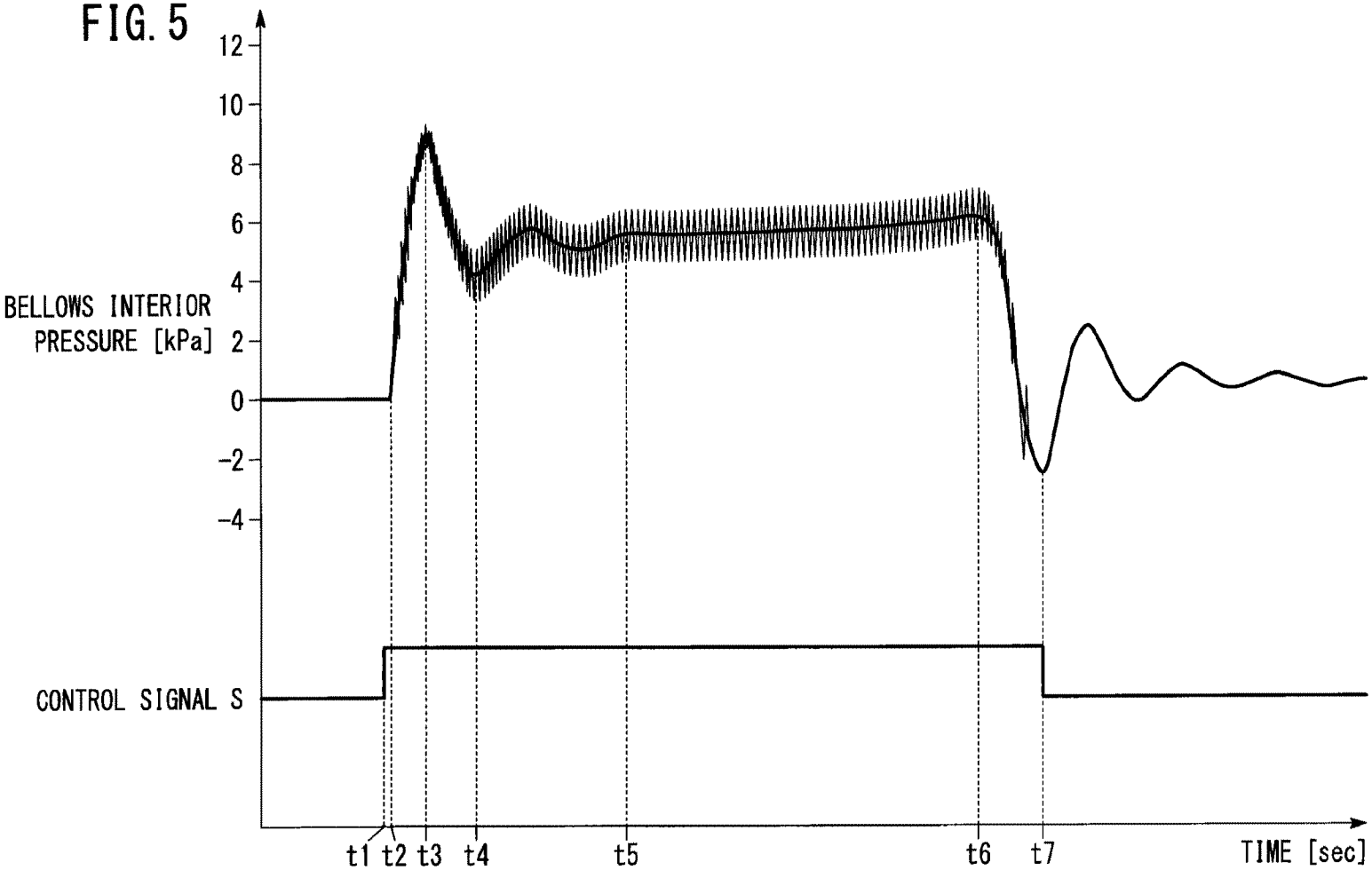
FIG. 5 is a graph illustrating by way of example changes in detection values of the pressure of indirect medium.

In other words, as shown in FIG. 5, the pressure of the indirect medium M begins to rise at a time t2 which is slightly later than time t1. Further, as shown in FIG. 5, the detection value of the indirect medium M, after having risen in pressure, fluctuates up and down over a minute time interval. This is considered to be because the indirect medium M comes into contact with the concave/convex portions of the bellows section 84 when the indirect medium M flows therein. Thus, hereinbelow, the pressure of the indirect medium M will be described based on an intermediate value (the solid line shown in FIG. 5) of the up/down fluctuating detection value. The intermediate value may be calculated by implementing an appropriate correction when the detection value is subjected to processing in the controller 18.

By an action of the pressing force, from a stopped state, the indirect medium M starts to flow in the distal end direction of the charge chamber 42, whereby the pressure of the indirect medium M rises sharply. Therefore, during the rising period from time t2 to t3 in FIG. 5, the detection value rises along a steep slope.

Figure 4:
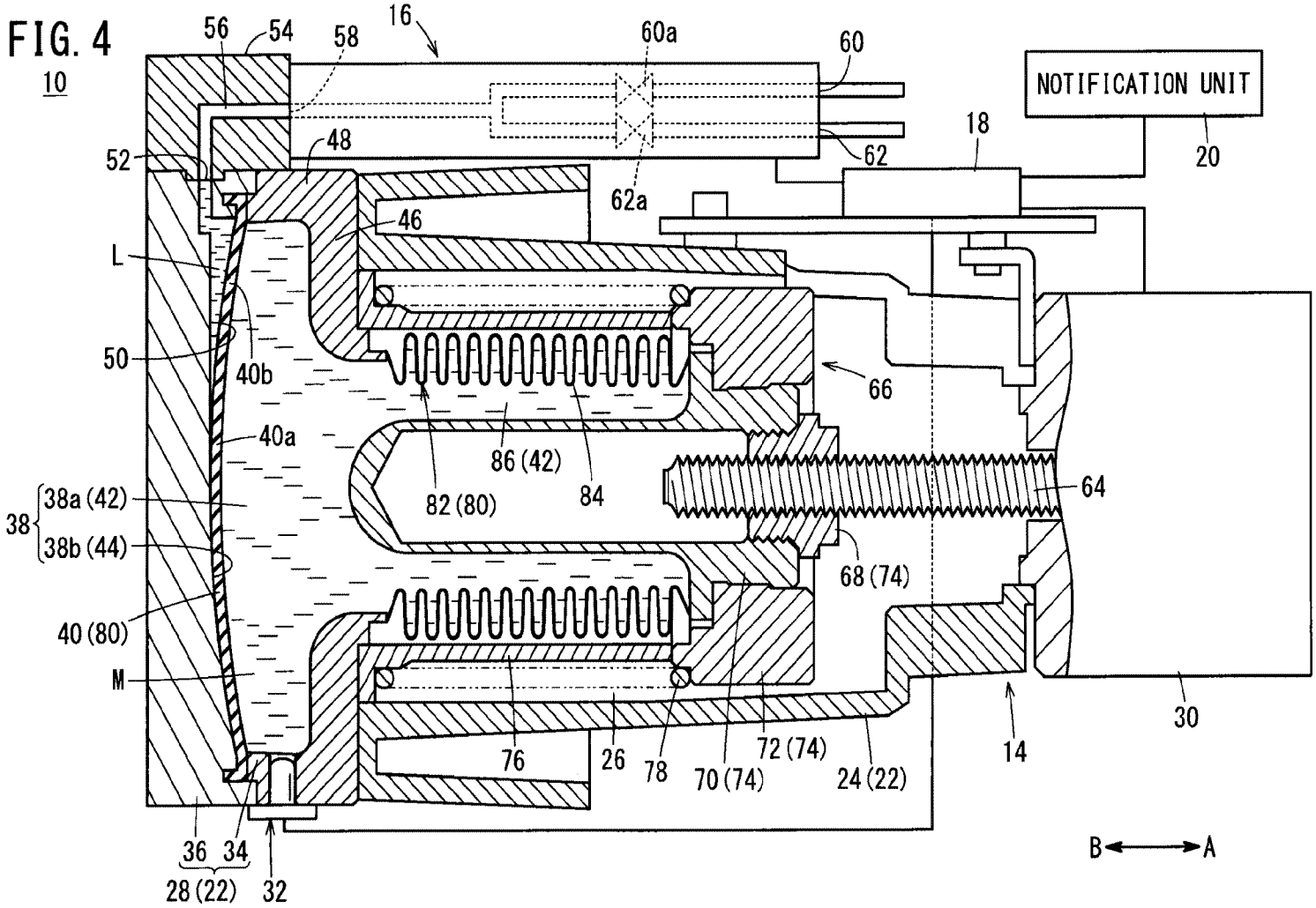
FIG. 4 is a second descriptive drawing showing a fluid discharging condition of the pump system.

As shown in FIG. 4, the diaphragm 40 is pressed by the flowing indirect medium M toward the hemispherical surface 44*a* of the pump chamber 44, and the main membrane 40*a* and the peripheral edge membrane 40*b* are deformed toward the distal end side. Consequently, the fluid L that has flowed into the pump chamber 44 is pressed out by the diaphragm 40 and flows into the fluid passage 50, and the fluid L flows out in a predetermined amount into the interior of the three-way valve 16 from the fluid port 52 and through the connecting passage 56 and the first port 58.

In the three-way valve 16, the solenoid valve 62*a* of the third port 62 opens, and the fluid L is allowed to flow from the first port 58, whereupon the fluid L is supplied to the coating liquid dispenser and is discharged (dispensed) onto the semiconductor. More specifically, concerning the indirect medium M in the charge chamber 42, the displacement amount of the displacement body 74 is made proportional to the flow amount of the fluid L that is discharged from the pump chamber 44 as a result of being pressed by the diaphragm 40. Therefore, responsive to the displacement amount of the displacement body 74 of the pump 14, the applied apparatus 12 can receive a constant discharge amount of the fluid L in a stable manner.

In the pump system 10, advancement of the displacement body 74 is carried out to a predetermined position where the distal end of the ring-shaped body 72 comes near to or in contact with the proximal end of the spring guide 76. As shown in FIG. 5, the pressure of the indirect medium M when the displacement body 74 is displaced in the distal end direction is such that, after the pressure exceeds a maximum pressure at time t3, the pressure falls back once in the interval from time t3 to time t4, thereafter, gently vibrates or fluctuates, and transitions to a stabilized state at time t5. Then, in the stable state period from time t5 to time t6, accompanying compression of the bellows member 82, the detection value exhibits a gradual rising tendency.

Following ejection of the fluid L (after time t6 in FIG. 5), the pump system 10 outputs a control signal S from the controller 18 to cause reverse rotation of the drive shaft 64 of the rotary drive source 30, and the displacement body 74 is retracted in the direction of the proximal end. Consequently, the bellows member 82 undergoes expansion, and at time t7, the indirect medium M acquires a most negative pressure (lowest pressure), and flows in the proximal direction (the direction of the arrow A).

Figure 3:
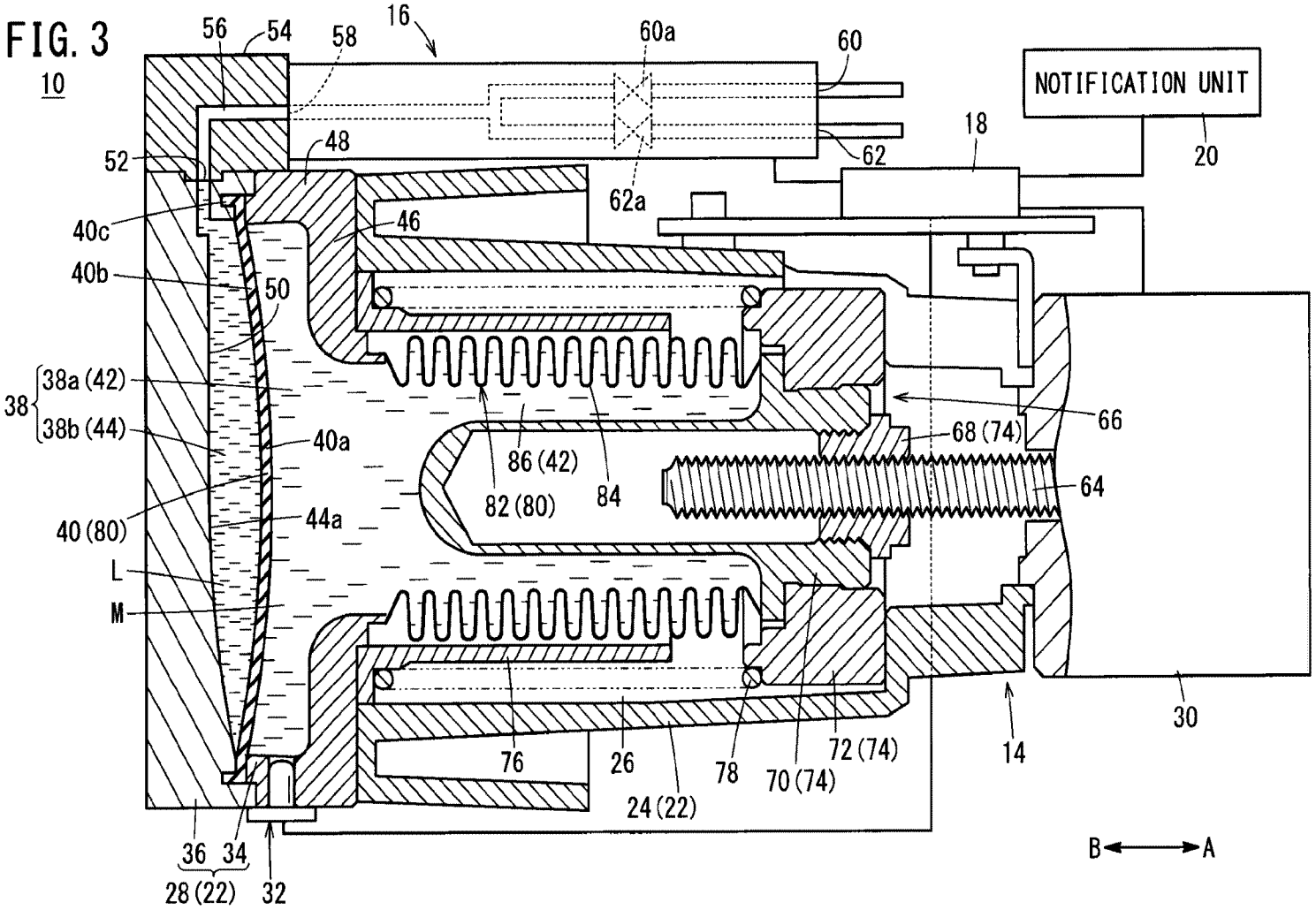
FIG. 3 is a first descriptive drawing showing a fluid aspirating condition (initial condition) of the pump system.

The displacement body 74 is retracted for a comparatively short time, and by the indirect medium M flowing in the direction of the proximal end responsive to expansion of the bellows member 82, as shown in FIG. 3, the diaphragm 40 once again is recessed in the proximal end direction. As a result, a negative pressure is developed in the pump chamber 44, the fluid L flows into the first port 58 from the second port 60 of the three-way valve 16, and the next amount of the fluid L is drawn into the pump chamber 44. In addition, by the displacement body 74 being restored to the initial condition (initial position) based on rotation of the drive shaft 64, the series of operations is brought to an end. By repeating the above operations, the pump system 10 continuously ejects or discharges a fixed amount of the fluid L for each series of operations.

In addition, in the pump system 10 according to the present embodiment, the pressure of the indirect medium M is detected by the pressure sensor 32, and the detection value that is detected is analyzed and monitored by the controller 18, whereby the state of the pump 14 (and in particular the diaphragm 40) is determined appropriately. As a method for detecting an abnormality of the diaphragm 40 by the controller 18, for example, the method may broadly be divided into the following techniques (A) through (C).

(A) Comparing the detection values with a threshold value;

(B) Determining a pressure waveform of the detection values; and (C) Determining a response delay of the detection values.

Below, various judgment methods carried out by the controller 18 will be described in greater detail.

(A) Comparing the Detection Values with a Threshold Value

[A-1. Comparison of Maximum Value of the Detection Values During Stable State Period with a Threshold Value]

Figure 6:
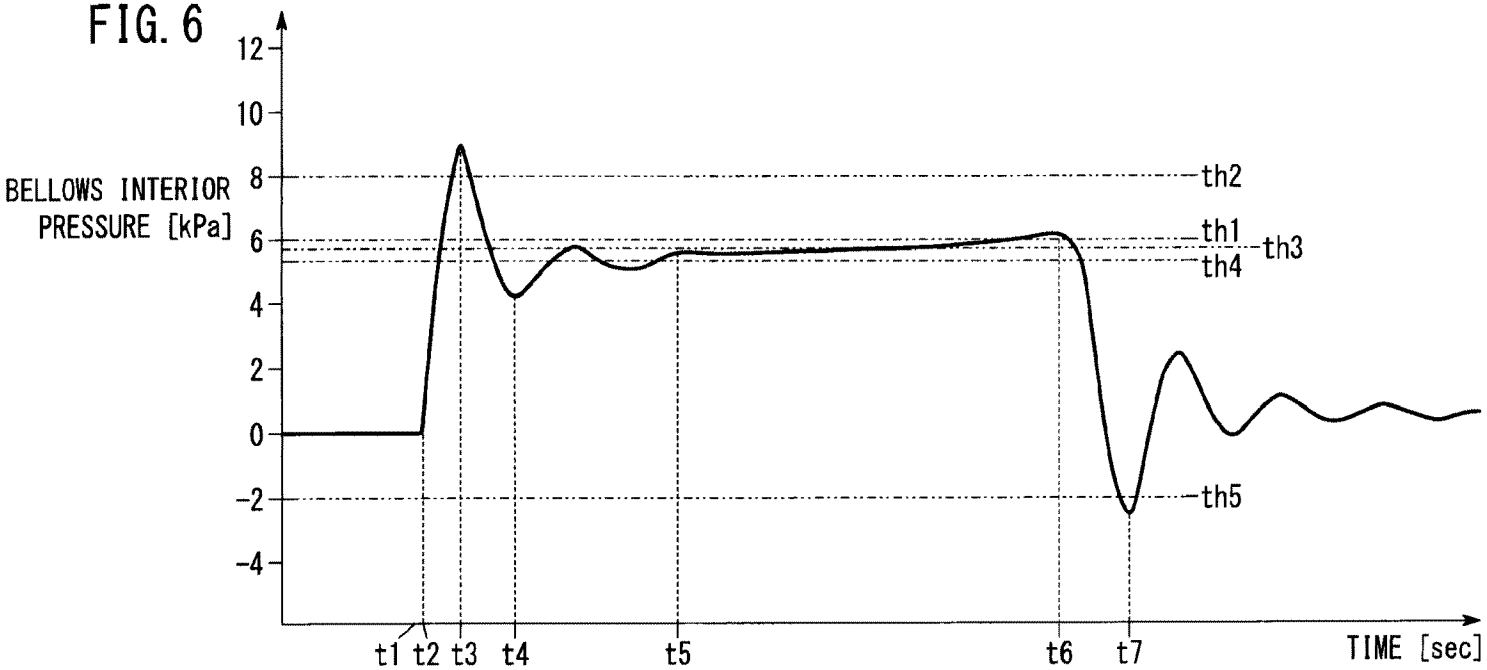
FIG. 6 is a first explanatory graph for describing a diaphragm abnormality detection method.

In the abnormality detection method for the diaphragm 40, as shown in FIG. 6, the controller 18 determines an abnormality of the diaphragm 40 by comparing the maximum value (maximum pressure) of the detection values applied to the indirect medium M during the aforementioned stable state period (from time t5 to time t6) with the threshold value th1. The threshold value th1 is a value that is set depending on the performance of the diaphragm 40, and is held (stored) beforehand in the controller 18 (storage unit). In addition, in the case that the maximum value of the detection values exceeds the threshold value th1, it is determined that the condition of the diaphragm 40 is normal, whereas if the maximum value of the detection values does not exceed the threshold value th1, the condition of the diaphragm 40 is determined to be abnormal. Stated otherwise, in the case that deterioration or damage to the diaphragm 40 has occurred, the pressure applied to the diaphragm 40 by the indirect medium M is weakened. In particular, during the stable state period, the maximum value of the detection values becomes substantially the same value when operations of the pump are carried out repeatedly at normal times. Therefore, by setting the threshold value th1, and monitoring a reduction in the maximum value of the detection values with respect to the threshold value th1, an abnormality of the diaphragm 40 can suitably be detected.

[A-2. Comparison Between Threshold Value and Maximum Value of Detection Values During Rising]

The controller 18 may hold in advance a threshold value th2 for comparison with a maximum value of the pressure imposed on the indirect medium M at the aforementioned rise time (time t3), and may be configured to compare the maximum value of the detection values with the threshold value th2. For example, in the case that the maximum value of the detection values exceeds the threshold value th2, it is determined that the diaphragm 40 is normal, whereas if the maximum value of the detection values does not exceed the threshold value th2, the diaphragm 40 is determined to be abnormal. With this method as well, since the pressure of the indirect medium M changes at the rise time due to abnormal operation of the diaphragm 40, an abnormality of the diaphragm 40 can suitably be detected.

[A-3. Comparison Between Threshold Value and Average Value of Detection Values During Stable State Period]

The controller 18 may hold in advance a threshold value th3 for comparison with an average value (average pressure) of the pressure imposed on the indirect medium M during the aforementioned stable state period (from time t5 to time t6), and may be configured to compare the average value of the detection values with the threshold value th3. For example, in the case that the average value of the detection values exceeds the threshold value th3, it is determined that the diaphragm 40 is normal, whereas if the average value of the detection values does not exceed the threshold value th3, the diaphragm 40 is determined to be abnormal. Stated otherwise, in the case that deterioration or damage to the diaphragm 40 has occurred, the pressure applied to the diaphragm 40 by the indirect medium M is weakened overall. Therefore, by monitoring a reduction in the average value of the detection values with respect to the threshold value th3, an abnormality of the diaphragm 40 can suitably be detected.

[A-4. Comparison Between Threshold Value and Minimum Value of Detection Values during the Stable State Period]

The controller 18 may hold in advance a threshold value th4 for comparison with a minimum value (minimum pressure) of the pressure imposed on the indirect medium M during the aforementioned stable state period (from time t5 to time t6), and may be configured to compare the minimum value of the detection values with the threshold value th4. For example, in the case that the minimum value of the detection values exceeds the threshold value th4, it is determined that the diaphragm 40 is normal, whereas if the minimum value of the detection values does not exceed the threshold value th4, the diaphragm 40 is determined to be abnormal. Therefore, by monitoring a reduction in the minimum value of the detection values with respect to the threshold value th4, an abnormality of the diaphragm 40 can suitably be detected.

[A-5. Comparison Between Threshold Value and Minimum Value of Detection Values During Falling]

The controller 18 may hold in advance a threshold value th5 for comparison with a minimum value of the pressure imposed on the indirect medium M at a falling time (time t7) of the pressure when the indirect medium M is made to flow in the direction of the proximal end, and may be configured to compare the minimum value of the detection values with the threshold value th5. For example, in the case that the minimum value of the detection values is less than the threshold value th5, it is determined that the diaphragm 40 is normal, whereas if the minimum value of the detection values is not less than the threshold value th5, the diaphragm 40 is determined to be abnormal. Therefore, by monitoring the minimum value of the detection values with respect to the threshold value th5, an abnormality of the diaphragm 40 can suitably be detected.

(B) Determination of Pressure Waveform of Detection Values

[B-1. Determination of Sum of Detection Values of Overall Waveform]

Figure 7:
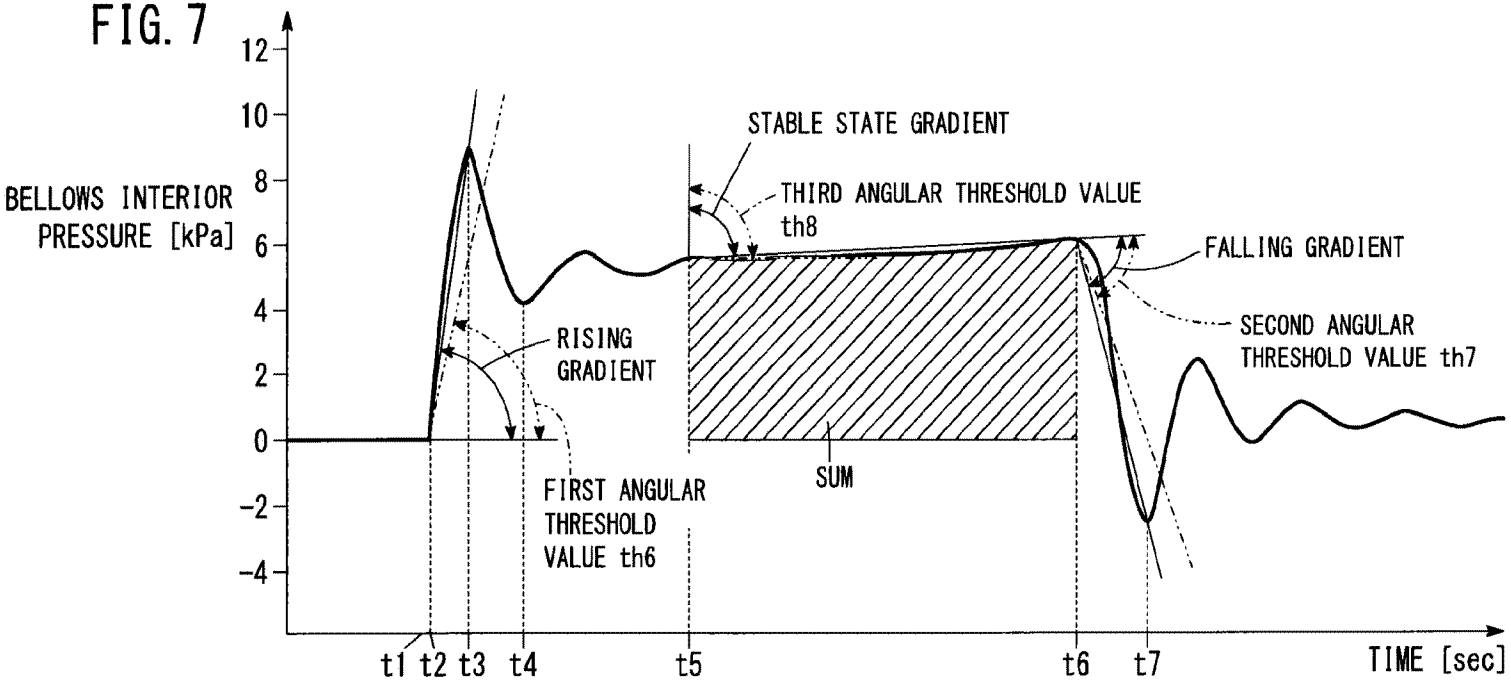
FIG. 7 is a second explanatory graph for describing a diaphragm abnormality detection method.

Further, in the abnormality detection method for the diaphragm 40, as shown in FIG. 7, a configuration may be provided in which the controller 18 determines an abnormality of the diaphragm 40 by monitoring the sum of the detection values during a stably discharging operation (from time t5 to time t6) where the pump 14 stably discharges the fluid L. In other words, by judging the total pressure applied by the indirect medium M, an abnormality of the diaphragm 40 can be determined with greater precision. The sum of the detection values can be calculated easily as the area (integral value) of the pressure waveform shown in FIG. 7. In this case, the controller 18 holds in advance a non-illustrated sum threshold value for comparison with the sum of the detection values, and compares the sum of the detection values with the sum threshold value. In addition, for example, in the case that the sum of the detection values exceeds the sum threshold value, it is determined that the diaphragm 40 is normal, whereas if the sum of the detection values does not exceed the sum threshold value, the diaphragm 40 is determined to be abnormal. In this case as well, since the pressure of the indirect medium M changes overall due to abnormal operation of the diaphragm 40, an abnormality of the diaphragm 40 can suitably be detected.

[B-2. Determination of Rising Gradient of Waveform]

The controller 18 may have a configuration in which an abnormality of the diaphragm 40 is determined by monitoring a rising gradient (angle) in a rising time period (from time t2 to time t3) of the pressure of the indirect medium M. The rising gradient may be calculated easily by the time period from time t2 to time t3, and the pressure value of time t3. The controller 18 holds in advance a first angular threshold value (threshold value th6) for comparison with the rising gradient, and compares the detected rising gradient with the first angular threshold value. In addition, for example, in the case that the rising gradient is greater than the first angular threshold value, it is determined that the diaphragm 40 is normal, whereas if the rising gradient is smaller than the first angular threshold value, the diaphragm 40 is determined to be abnormal. In this case as well, an abnormality of the diaphragm 40 can suitably be detected.

[B-3. Determination of Falling Gradient of Waveform]

The controller 18 may have a configuration in which an abnormality of the diaphragm 40 is determined by monitoring a falling gradient (angle) in a falling time period (from time t6 to time t7) of the pressure of the indirect medium M. The falling gradient may be calculated easily by the time period from time t6 to time t7, and the pressure values of times t6, t7. The controller 18 holds in advance a second angular threshold value (threshold value th7) for comparison with the falling gradient, and compares the detected falling gradient with the second angular threshold value. In addition, for example, in the case that the falling gradient is greater than the second angular threshold value, it is determined that the diaphragm 40 is normal, whereas if the falling gradient is smaller than the second angular threshold value, the diaphragm 40 is determined to be abnormal. In this case as well, an abnormality of the diaphragm 40 can suitably be detected.

[B-4. Determination of Gradient of Detection Values During Stable State Period]

The controller 18 may have a configuration in which an abnormality of the diaphragm 40 is determined by monitoring a gradual rise in the pressure of the indirect medium M during a stable state period (referred to below as a stable state gradient). The controller 18 holds in advance a third angular threshold value (threshold value th8) for comparison with the stable state gradient, and compares the detected stable state gradient with the third angular threshold value. In addition, for example, in the case that the stable state gradient is larger than the third angular threshold value, it is determined that the diaphragm 40 is normal, whereas if the stable state gradient is smaller than the third angular threshold value, the diaphragm 40 is determined to be abnormal. In this case as well, an abnormality of the diaphragm 40 can suitably be detected.

(C) Determination of Detection Value Response Delay

[C-1. Determination of Time Delay Between Operation of Rotary Drive Source 30 and Rise in Pressure of Indirect Medium M]

Returning to FIG. 5, the controller 18 may have a configuration in which an abnormality of the diaphragm 40 is determined by calculating a time delay between time t1 when operation of the rotary drive source 30 is started, and time t2 at which the pressure of the indirect medium M starts to rise. More specifically, in the case that deterioration or damage to the diaphragm 40 has occurred, even though flowing of the indirect medium M takes place, a response of the change in pressure is presumed to be slow. In this case, the controller 18 holds in advance a time period threshold (not shown) for comparison with the rising time, and compares such a threshold with a time period of the detected time delay (from time t1 to time t2). In addition, for example, in the case that the time period of the rising time delay is smaller than the time period threshold, it is determined that the diaphragm 40 is normal, whereas if the time period of the rising time delay is greater than the time period threshold, the diaphragm 40 is determined to be abnormal. In this case as well, an abnormality of the diaphragm 40 can suitably be detected. Moreover, the determination based on the pressure time delay is not limited to a rise in the pressure, but may also be based on a timing of a fall in the pressure.

[C-2. Determination of Delay in Transitioning from Rise to Stable State Period in Pressure of Indirect Medium M]

The controller 18 may have a configuration in which an abnormality of the diaphragm 40 is determined by calculating a transition time from time t3 at which the pressure of the indirect medium M is applied, to time t5 when transitioning to the stable state period. More specifically, in the case that deterioration, etc., of the diaphragm 40 occurs, it is presumed that the time period for transitioning to the stable state period changes (becomes longer or becomes shorter) from the normal condition. Consequently, the controller 18 holds in advance a time period threshold value (not shown) for comparison with the transition time, and by comparing such a threshold value with the detected transition time, can detect an abnormality of the diaphragm 40.

Moreover, the controller 18 need not merely perform only one of the above-described methods in detecting an abnormality of the diaphragm 40, but may combine a plurality of different methods. Owing thereto, an abnormality of the diaphragm 40 can be detected with greater accuracy. Further, the controller 18 may repeatedly carry out a plurality of discharging events from the pump 14, the pressure waveform of the detection values may be obtained a plurality of times, and an abnormality of the diaphragm 40 may be determined using the plural pressure waveforms. Consequently, an abnormality of the diaphragm 40 can be determined with higher accuracy.

Furthermore, the pump system 10 may further comprise a flow meter that detects a flow amount of the fluid L discharged from the pump head 28, and may be configured to determine an abnormality of the pump 14 (diaphragm 40) by taking into consideration, in addition to the aforementioned methods, a change in the flow amount of the fluid L. Still further, although according to the present embodiment, an abnormality of the diaphragm 40 is determined using an intermediate value of the upward/downward fluctuating detection values, the controller 18 may also determine an abnormality of the diaphragm 40 based on the peak of a mountain or the depth of a valley of the upward/downward fluctuation.

Figure 8:
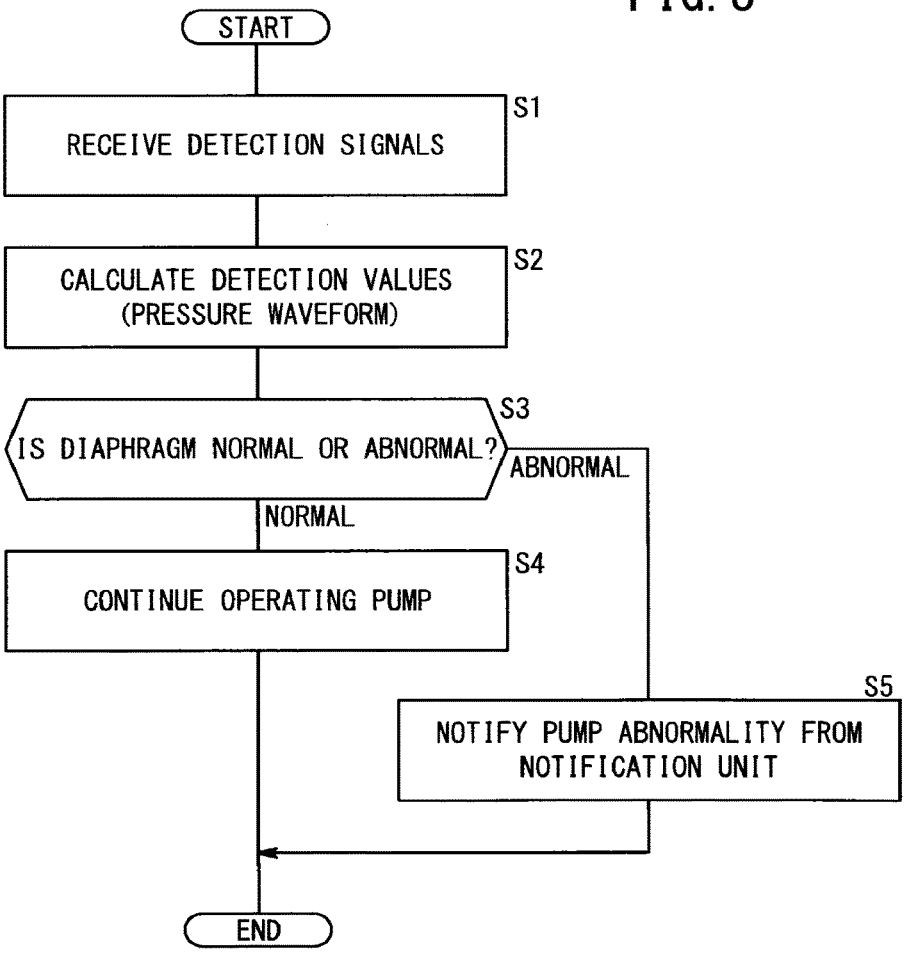
FIG. 8 is a flowchart showing an abnormality detection process flow of the pump system.

As has been described above, by adopting the aforementioned methods, the pump system 10 is capable of determining an abnormality of the diaphragm 40 at an early state, based on detection values detected by the pressure sensor 32. For example, the controller 18 implements an abnormality detection of the pump 14 according to the flowchart shown in FIG. 8.

After start of operations of the pump system 10, the controller 18 receives a detection signal P transmitted from the pressure sensor 32 (step S1: pressure detecting step). In addition, the controller 18 performs an appropriate process on the acquired detection signal P, calculates detection values (pressure waveform) that represent the pressure of the indirect medium M, and temporarily stores the detection values (step S2). At the time of calculation, by performing a process to obtain the detection values corresponding to the adopted abnormality detection method for the pump 14, the processing load thereafter is reduced.

Furthermore, the controller 18 determines an abnormality of the diaphragm 40 by means of the aforementioned abnormality detection method for the pump 14, based on the calculated detection values (step S3: determination process step). If the diaphragm 40 is determined to be normal, operation of the pump 14 is continued (step S4), and the abnormality detection process is brought to an end. In addition, after elapse of a predetermined time period, the process is repeated again from the start. On the other hand, if an abnormality of the diaphragm 40 is determined to exist, in step S5, the notification unit 20 is operated, and a notification is carried out to indicate the presence of an abnormality of the pump 14. Consequently, it is possible for an abnormality of the pump 14 to be suitably recognized by the operator of the applied apparatus 12. Further, concerning processing after determining the presence of an abnormality, in addition to the notification by the notification unit 20 (or instead of the notification of the notification unit 20), processes may be implemented such as halting driving of the rotary drive source 30, halting operation of the three-way valve 16, or halting operation of the applied apparatus 12, etc.

According to the pump system 10, as noted above, by providing the pressure sensor 32 that detects a pressure of the indirect medium M, and the controller 18 that determines an abnormality in the diaphragm 40 based on the detection values, an abnormality of the diaphragm 40 can be confirmed easily and quickly. More specifically, since the pressure of the indirect medium M in the charge chamber 42 acts directly on the deformation of the diaphragm 40, by the controller 18 monitoring such a pressure, an abnormality of the diaphragm 40 can rapidly be discovered. Consequently, for example, it is possible to carry out maintenance or exchange of the pump 14 at an early stage, and an abnormality of the pump 14 (a change in the discharge rate of the fluid L, leakage of the indirect medium M, etc.) for which there is a possibility of occurring in the applied apparatus 12 can suitably be suppressed.

Further, in the pump system 10, also in the case that the fluid L becomes empty during use of the pump 14, since there is a change in the pressure waveform of the indirect medium M, the condition of the fluid L can be confirmed by the pressure sensor 32 and the controller 18. Furthermore, if there is a change in the flow rate of the fluid L caused by an abnormality of the rotary drive source 30 or the solenoid valves 60*a*, 62*a*, since the waveform of the indirect medium M also experiences a change, apart from an abnormality of the diaphragm 40, the pump system 10 also is capable of detecting an abnormality of the rotary drive source 30 or the solenoid valves 60*a*, 62*a*.

Additionally, in the pump system 10, by insertion and fixing of the detector 32*a* of the pressure sensor 32 in the charging port 88, the charge chamber 42 can easily be closed and sealed, and the pressure of the charge chamber 42 can reliably be detected. Furthermore, because there is no need to dispose the pressure sensor 32 separately on the body 22 or the like, the structure of the pump system can be simplified.

In the description above, although a preferred embodiment of the present invention has been presented, the present invention is not limited to this embodiment. It goes without saying that various modifications may be adopted therein within a scope that does not deviate from the essential gist of the present invention. For example, the controller 18 need not necessarily hold or store beforehand the threshold values for detecting abnormalities, and such threshold values may be set using pressure waveforms at times of normal operation. Further, the controller 18 may determine that an abnormality of the diaphragm 40 exists by extracting respective pressure waveforms over each predetermined period and comparing the degree of change.

What is claimed is:

1. A pump system comprising:

a body having a pump chamber;

a displacement body configured to be displaceable along an axial direction of the body in an interior of the body;

a connector interposed between the displacement body and the body;

an indirect medium comprising a non-compressible fluid, and with which a charge chamber including an interior space is charged, the connecting member liquid-sealing the indirect medium in the interior space at the interior of the body; and a diaphragm disposed between the charge chamber and the pump chamber in the interior of the body, and configured to, under a flowing action of the indirect medium, cause a fluid to flow into and flow out of the pump chamber, the pump system further comprising:

a pressure detector configured to detect a pressure of the indirect medium in the charge chamber; and a judgment processor configured to analyze detection values detected by the pressure detector and determine a normality or an abnormality of the diaphragm based on the analyzed detection values, wherein:

the body includes a charging port that communicates with the charge chamber, the charge chamber being charged with the indirect medium through the charging port; and the pressure detector includes a detector, the detector being inserted and fixed in the charging port and closing the charging port.

2. The pump system according to claim 1, wherein the pressure detector is disposed at a position adjacent the diaphragm.

3. The pump system according to claim 1, wherein the pump system further comprises a notification unit configured to notify presence of the abnormality of the diaphragm, in a case that the judgment processor determines that the abnormality of the diaphragm exists.

4. The pump system according to claim 1, wherein:

the pump system further comprises a solenoid valve configured to supply the fluid to the pump chamber or discharge the fluid from the pump chamber; and the judgment processor halts operation of the solenoid valve in a case it is determined that the abnormality of the diaphragm exists.

5. The pump system according to claim 1, wherein:

the pump system further comprises a drive unit including a shaft on an end of the body, the drive unit being configured to displace the displacement body along the axial direction upon energizing of the drive unit; and the judgment processor halts energizing of the drive unit in a case it is determined that the abnormality of the diaphragm exists.

6. The pump system according to claim 1, wherein:

the pump system is disposed on an apparatus that receives outflow of the fluid from the pump chamber; and the judgment processor is connected to a control unit of the apparatus or is installed with respect to the control unit, and halts operation of the apparatus in a case it is determined that the abnormality of the diaphragm exists.

7. The pump system according to claim 1, wherein the judgment processor determines the abnormality of the diaphragm, by comparing, with a threshold value, a maximum pressure in a stable state period within a pressure waveform of the detection values.

8. The pump system according to claim 1, wherein the judgment processor determines the abnormality of the diaphragm, by comparing, with a threshold value, an average pressure in a stable state period within a pressure waveform of the detection values.

9. The pump system according to claim 1, wherein the judgment processor determines the abnormality of the diaphragm, by comparing, with a threshold value, a minimum pressure in a stable state period within a pressure waveform of the detection values.

10. The pump system according to claim 1, wherein the judgment processor determines the abnormality of the diaphragm, by comparing, with a threshold value, a maximum pressure during a rise in pressure within a pressure waveform of the detection values.

11. The pump system according to claim 1, wherein the judgment processor determines the abnormality of the diaphragm, by calculating a sum of the detection values within a predetermined period, and comparing the sum with a sum threshold value.

12. The pump system according to claim 1, wherein the judgment processor determines the abnormality of the diaphragm, by comparing, with an angular threshold value, a gradient of a pressure waveform of the detection values.

13. The pump system according to claim 1, wherein the judgment processor determines the abnormality of the diaphragm, by detecting a time delay of a rise or a fall in pressure from within a pressure waveform of the detection values.

14. The pump system according to claim 1, wherein the judgment processor determines the abnormality of the diaphragm, by detecting a time delay until transitioning to a stable state from within a pressure waveform of the detection values.

15. The pump system according to claim 1, wherein the judgment processor determines the abnormality of the diaphragm, by performing a plurality of different types of judgments.

16. The pump system according to claim 1, wherein the judgment processor determines the abnormality of the diaphragm, using a plurality of pressure waveforms of the detection values.

17. A pump abnormality detection method for a pump, the pump including:

a body having a pump chamber;

a displacement body configured to be displaceable along an axial direction of the body in an interior of the body;

a connector interposed between the displacement body and the body;

an indirect medium comprising a non-compressible fluid, and with which a charge chamber including an interior space is charged, the connecting member liquid-sealing the indirect medium in the interior space at the interior of the body; and a diaphragm disposed between the charge chamber and the pump chamber in the interior of the body, and configured to, under a flowing action of the indirect medium, cause a fluid to flow into and flow out of the pump chamber, the pump abnormality detection method comprising the steps of:

detecting a pressure of the indirect medium in the charge chamber, with a pressure detector; and determining an abnormality of the diaphragm based on detection values detected by the pressure detector, with a judgment processor configured to analyze detection values detected by the pressure detector and determine a normality or an abnormality of the diaphragm based on the analyzed detection values, wherein:

the body includes a charging port that communicates with the charge chamber, the charge chamber being charged with the indirect medium through the charging port; and the pressure detector includes a detector, the detector being inserted and fixed in the charging port and closing the charging port.

* * * * *